US005917923A

United States Patent [19]

Caron et al.

[11] Patent Number: 5,917,923

[45] Date of Patent: Jun. 29, 1999

[54] SATELLITIC COMPACT ELECTROACOUSTICAL TRANSDUCING

[75] Inventors: Gerald F. Caron, Andover; Rakesh C. Pandey, Natick; Ricardo F. Carreras, Southborough; Osman K. Isvan, Wayland; Dorie A. Sabol, Boston; Charles Ralph Barker, III, Harvard; Thomas C. Schroeder, Farmingham, all of Mass.

[73] Assignee: Bose Corporation, Framingham, Mass.

[21] Appl. No.: 08/545,121

[22] Filed: Oct. 19, 1995

Related U.S. Application Data

[63] Continuation of application No. 08/443,625, May 18, 1995, abandoned.

[51] Int. Cl.[6] ..... H04R 25/00

[52] U.S. Cl. ..... 381/345; 381/300; 381/370

[58] Field of Search ..... 381/59, 88, 89, 381/90, 154, 158, 159, 345, 346, 352, 353, 349, 370, 371, 300, 74, 412, 414, 420, 400, 409, FOR 159, FOR 149, FOR 150; 181/145, 146, 156, 198, 199

[56] References Cited

U.S. PATENT DOCUMENTS

| | | | |
|---|---|---|---|
| 2,852,087 | 9/1958 | Ruschhaupt | 181/151 |
| 2,951,190 | 8/1960 | Baermann | 381/201 |
| 3,006,430 | 10/1961 | Petrie et al. | 381/204 |
| 3,134,057 | 5/1964 | Tsunoo et al. | 381/199 |
| 3,191,421 | 6/1965 | Coen | 381/201 |
| 4,410,768 | 10/1983 | Nakamura et al. | 381/194 |
| 4,418,247 | 11/1983 | Hansen | 381/202 |
| 4,549,631 | 10/1985 | Bose | 181/155 |
| 4,577,069 | 3/1986 | Keezer | 381/201 |
| 4,644,581 | 2/1987 | Sapiejewski | 381/158 |
| 4,932,060 | 6/1990 | Schreiber | 381/24 |
| 5,092,424 | 3/1992 | Schreiber et al. | 181/145 |
| 5,181,252 | 1/1993 | Sapiejewski et al. | 381/158 |
| 5,249,236 | 9/1993 | Sakamoto | 381/194 |
| 5,583,944 | 12/1996 | Morohoshi | 381/194 |

FOREIGN PATENT DOCUMENTS

| | | | |
|---|---|---|---|
| 0120197 | 5/1989 | Japan | 381/159 |
| 0087898 | 3/1990 | Japan | 381/159 |
| 0208497 | 9/1991 | Japan | 381/199 |
| 403291100 | 12/1991 | Japan | 381/199 |
| 2251355 | 7/1992 | United Kingdom | 381/199 |

*Primary Examiner*—Huyen Le
*Attorney, Agent, or Firm*—Fish & Richardson PC

[57] ABSTRACT

A loudspeaker system includes an upper frequency assembly that radiates acoustical energy having spectral components in the audio frequency range above a predetermined upper frequency, typically at the high end of the bass frequency range between 150 and 200 Hz. The assembly includes a ported enclosure with a front face enclosing a loudspeaker driver with a cone adjacent to the front face of diameter slightly less than at least one of the height and width of the enclosure.

26 Claims, 6 Drawing Sheets

SATELLITIC COMPACT ELECTROACOUSTICAL TRANSDUCING

This application is a continuing application of application Ser. No. 08/443,625 filed May 18, 1995 now abandoned.

The present invention relates in general to satellitic electroacoustical transducing and more particularly concerns novel apparatus and techniques for reproducing substantially the full range of audible frequencies with a nonlocalizable bass enclosure such as disclosed in U.S. Pat. No. 5,092,424, incorporated by reference herein, reproducing the bass frequency range and with exceptionally small satellite enclosures reproducing the upper frequency range that typically extends above a frequency at the high end of bass frequencies, typically within the range of 150 to 200 Hz.

For background, reference is made to U.S. Pat. No. 4,932,060 entitled STEREO ELECTROACOUSTICAL TRANSDUCING granted Jun. 5, 1990, incorporated by reference herein.

It is an important object of the invention to provide an improved stereo electroacoustical transducing system.

According to the invention, there is a bass enclosure that radiates acoustic energy having spectral components in the bass frequency range up to a predetermined upper frequency, typically within the range of 150 to 200 Hz and at least one upper frequency driver in a very small enclosure that radiates spectral components in the audible frequency range above the predetermined upper frequency. For a stereo system there are at least left and right ones of these upper frequency radiating assemblies. Preferably, there are at least left and right pairs of these upper frequency assemblies with the assemblies in a pair contiguous and relatively angularly displaceable about a common axis. Each assembly includes a driver adjacent to and in a front panel of the enclosure having a cone or diaphragm diameter slightly less than the width and/or height of the enclosure, the front panel typically being a square of predetermined height and width and less than approximately 5.0 cm. The diameter of the driver voice coil is comparable to or greater than the diaphragm radius. The cross-sectional area of the enclosure corresponds substantially to that of the front panel for most of the enclosure length. The enclosure is ported. The driver typically has an efficiency $\beta$ of at least 1.6 Newtons$^2$ per watt expressed as the ratio of mechanical force production to the thermal loss incurred while producing that force as is known in the art and fully described in U.S. Pat. No. 5,216,723 entitled PERMANENT MAGNET TRANSDUCING in column 6. The upper frequency assembly is constructed and arranged to provide a predetermined maximum sound level of at least 90 and preferably 99 or 105 dB over substantially all the audible frequency range above the predetermined upper frequency without audible distortion as conventionally measured one meter from the driver on the driver axis in an anechoic environment.

When upper frequency assemblies, or satellites, and the nonlocalizable bass enclosure are arranged in a typical listening room, localization only occurs on the satellites. That is to say, the listener perceives all the sound as coming from the satellites, although the listener perceives the nonlocalizable bass spectral components radiated by the nonlocalizable bass enclosure, which may be hidden, with any ports having an opening in an outside wall of the bass enclosure being free of obstructions. Typically, the distance between each satellite and the nonlocalizable bass enclosure is less than about 10 meters.

According to another aspect of the invention, there is a two-terminal connector at the rear constructed and arranged to interconnect smaller gauge wire leads from the driver inside the enclosure to larger gauge wire outside of the enclosure that connects the drivers to the amplifier.

According to still another feature of the invention, the rear of the enclosure is constructed and arranged to form an acoustic impedance between the driver and the input to the main port to suppress transmission of spectral components above a predetermined middle frequency, typically of the order of 800 Hz.

Numerous other features, objects and advantages of the invention will become apparent from the following detailed description when read in connection with the accompanying drawing in which.

Figure 1:
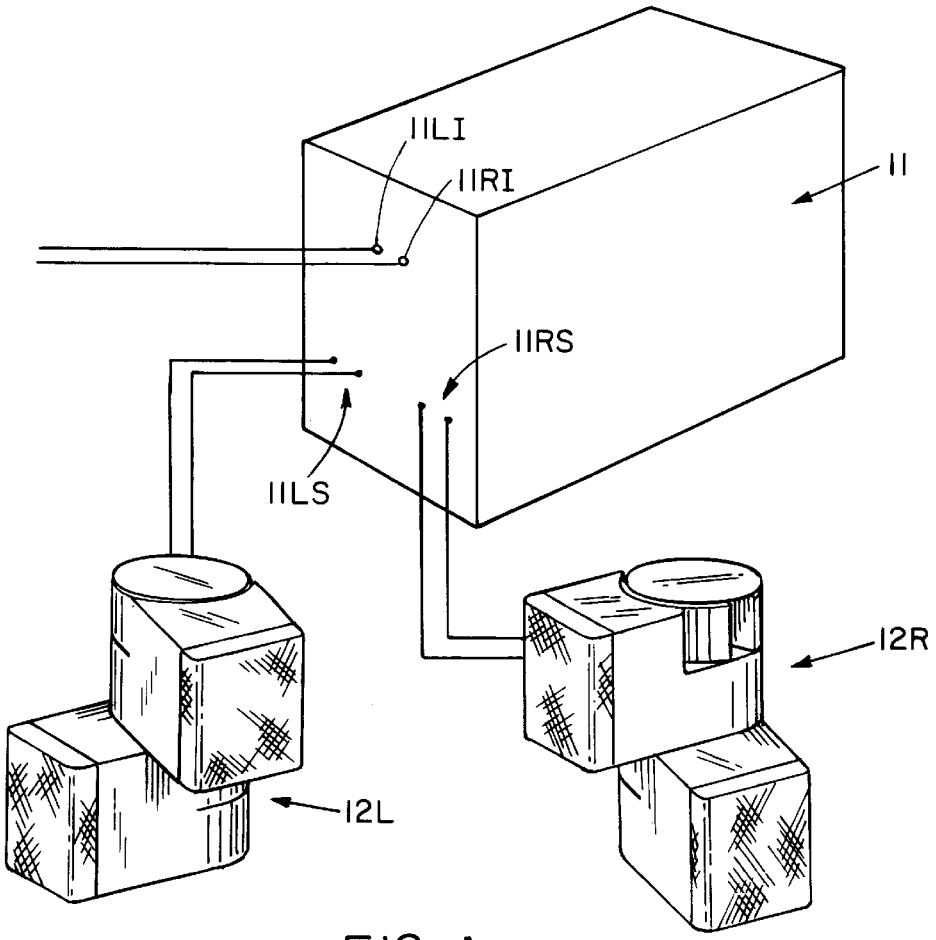
FIG. 1 is a block diagram illustrating the logical arrangement of a satellitic electroacoustical transducing system according to the invention.

With reference now to the drawings and more particularly FIG. 1 thereof, there is shown a pictorial diagram illustrating the logical arrangement of a system according to the invention. A bass enclosure 11 receives left and right stereo input signals at input terminals 11LI and 11RI, respectively, and furnishes left and right upper frequency range signals having spectral components above the predetermined upper frequency at satellite output terminals 11LS and 11RS, respectively, connected to left and right upper frequency assemblies 12L and 12R, respectively.

Figure 2:
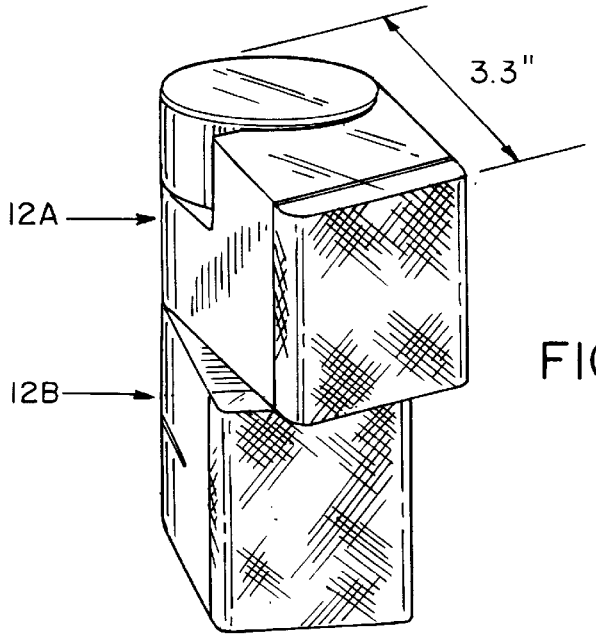
FIG. 2 is a perspective view of an upper frequency assembly according to the invention.

Referring to FIG. 2, there is shown a perspective view of an upper frequency assembly according to the invention comprising an upper enclosure 12A pivotally connected to a lower enclosure 12B.

Figure 3:
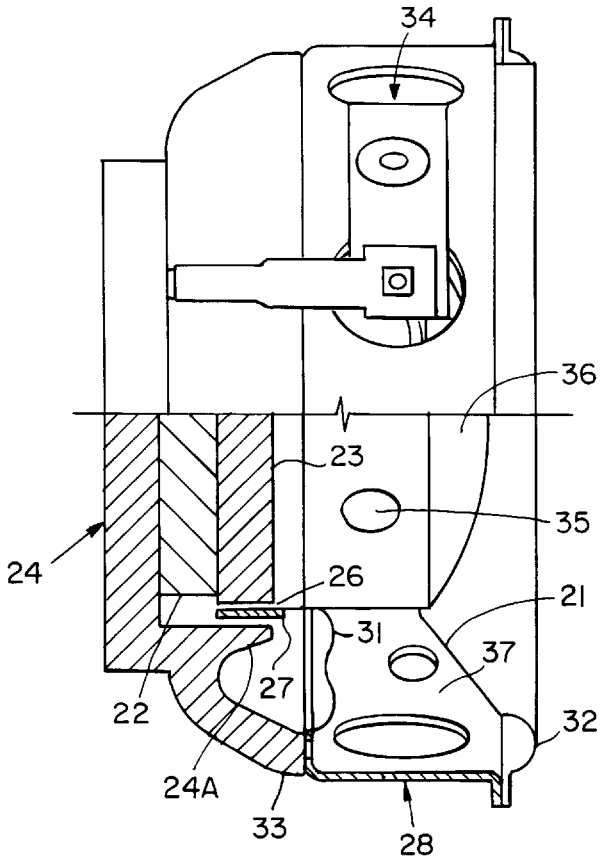
FIG. 3 is a diametrical sectional view of a driver according to the invention.
Figure 4:
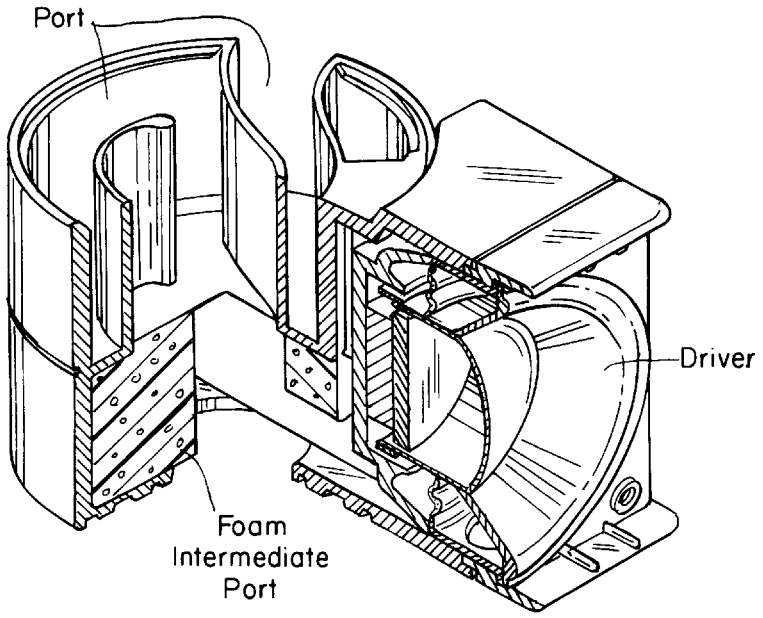
FIG. 4 is a perspective view partially in section of the enclosure according to the invention.

Referring to FIG. 3, there is shown an elevation view partially in diametrical section of an embodiment of a driver according to the invention. The driver includes cone 21, magnet 22, central pole piece 23 and pot 24. Air gap 26 between central pole piece 23 and flange 24A of pot 24 accommodates voice coil 27. Pot 24 is formed with end portions 33 connected to basket 28 that functions to confine flux substantially within the enclosure. That is to say, pot 24 is a magnetic structure formed with an annular extension 33 with an air space between the end of the extension and a portion 24A of the pot adjacent to voice coil 27 to reduce magnetic fringing flux. The voice coil leadouts are not attached to the undersurface of cone 21 and are connected to terminals, one of which 30 is shown in FIG. 3, there being another diametrically opposite and also extending substantially parallel to the driver axis and all free of contact with cone 21. An advantage of having the voice coil leadouts free of contact with the cone is that the cone mass is reduced when compared with the same cone having voice coil leadouts attached to the cone surface, thereby helping to improve the high frequency response of the driver. Another advantage is the elimination of asymmetrical mass loading which occurs when the leadouts engage the cone.

Figure 5A:
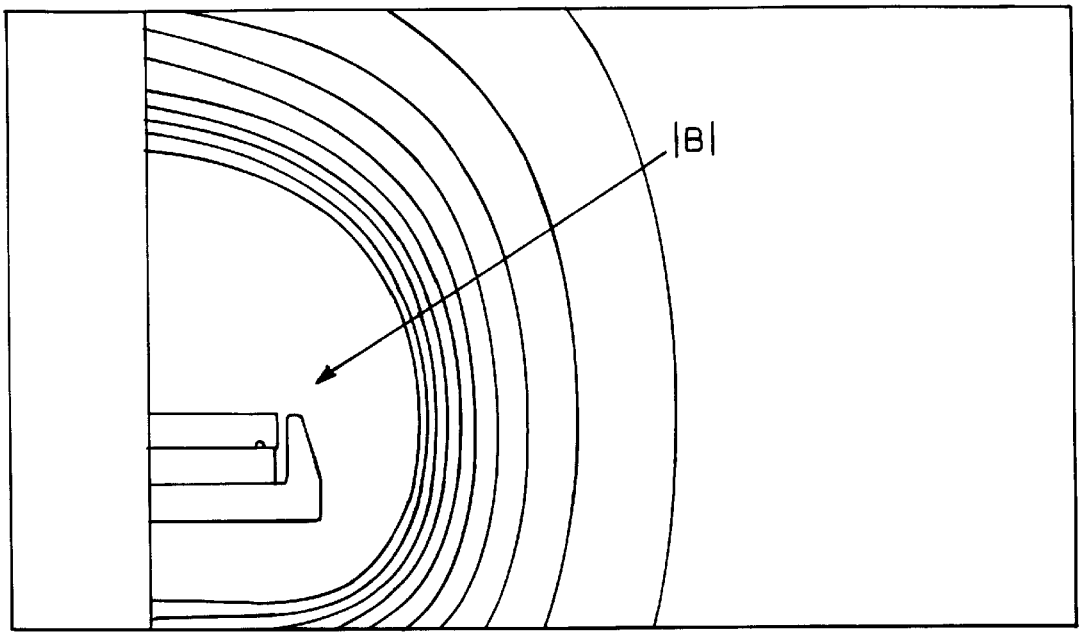
FIGS. 5A and 5B illustrate the improvement of fringing flux properties of the driver according to the invention in FIG. 5B in comparison with a conventional pot magnet structure in FIG. 5A.
Figure 5B:
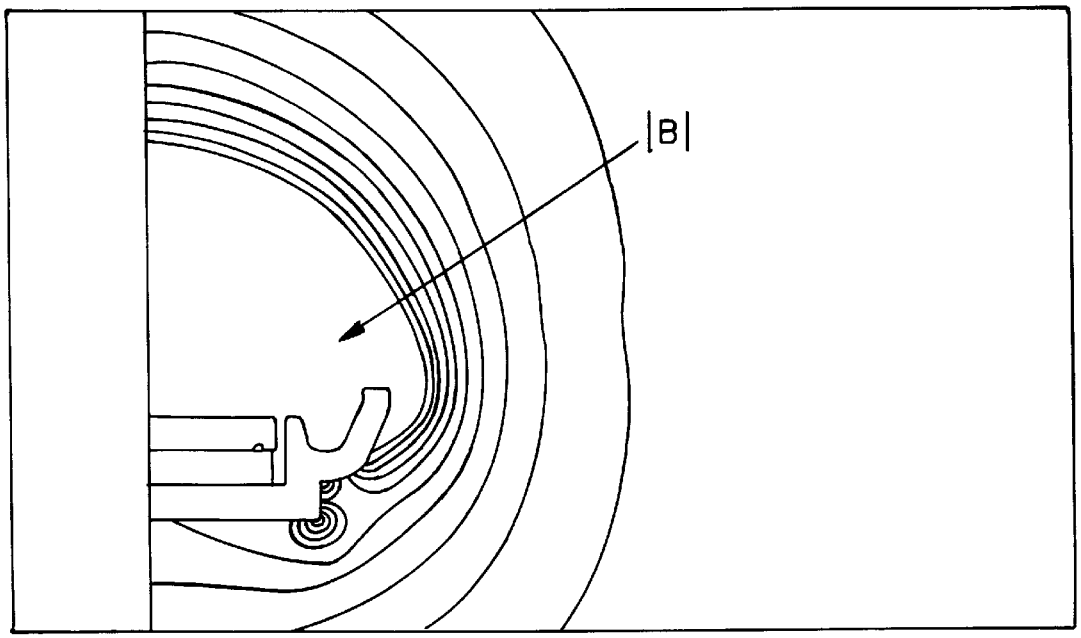

FIG. 5A shows contours of the magnitude of magnetic flux density for a conventional pot and FIG. 5B, for a pot with end portions 33.

Surround 32 and spider 31 provide dual suspension points that allow axial motion of cone 21 and voice coil 27 without lateral motion. The moving assembly of the driver has two flexible members at different axial locations, surround 32 and spider 31. The moving assembly is mounted on a rigid subassembly best seen in FIG. 3 comprising basket 28 separate from the magnetic structure comprising pot 24, magnet 22 and central pole piece 23. It is advantageous to mount the moving assembly on the rigid subassembly to form a subcombination and then attach this subcombination and the magnetic structure together to form the driver. Spider 31 has a corresponding relatively high ratio of outer diameter to inner diameter and with only two rolls furnishes sufficient compliance to allow adequate displacement of voice coil 27 in the ported enclosure. Magnet 22 is made of material, such as neodymium-iron boron or other suitable rare-earth-based magnetic material.

Figure 6:
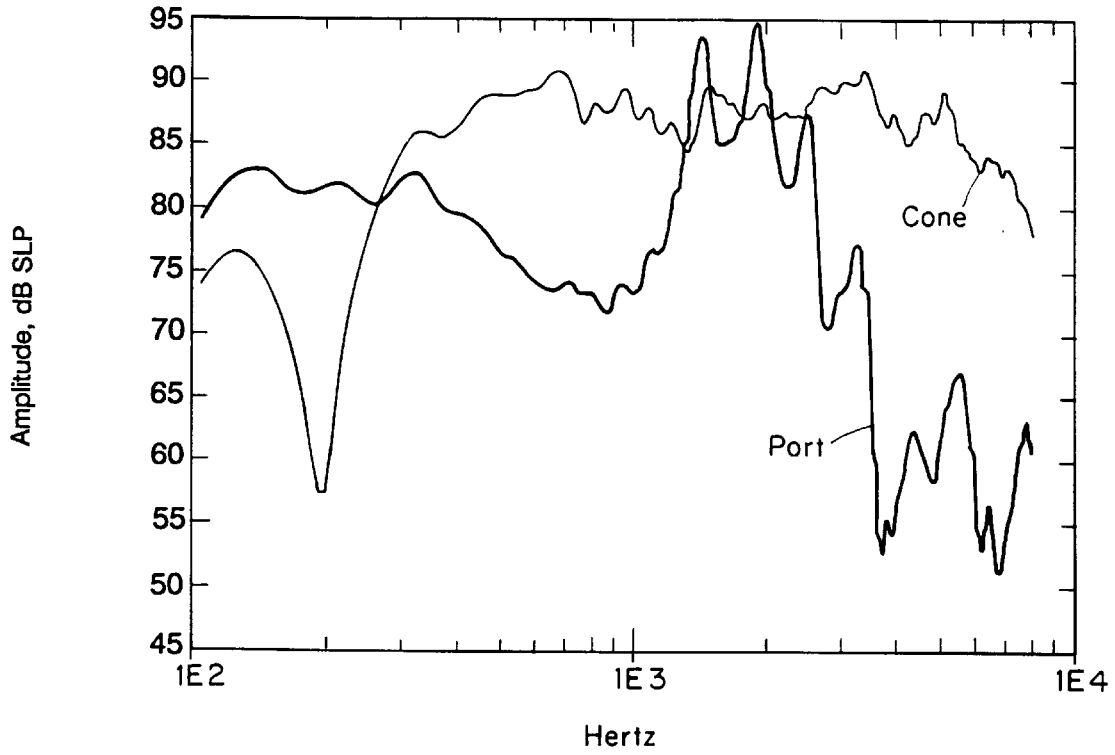
FIG. 6 shows the frequency response of the upper frequency assembly according to the invention without the additional mass-compliance between driver and main port outlet.
Figure 7:
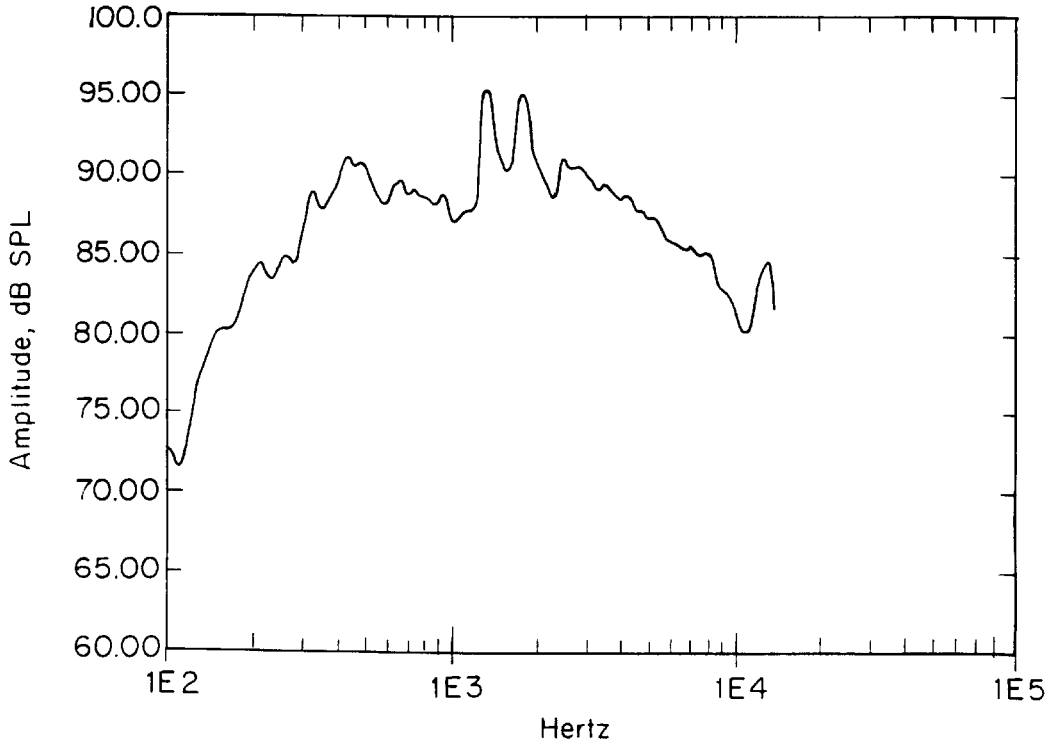
FIG. 7 shows the averaged frequency response in a room of the upper frequency assembly according to the invention without the added mass-compliance between driver and main port outlet.

Air masses in holes 34 of basket 28 and in holes in voice-coil bobbin 35 resonate with the volume of air under dust cap 36 and the volume of air 37 under cone 21 to provide undesired resonances. Referring to FIG. 6, there is shown the effect of these resonances on the frequency response of the cone output and of the main port output of an upper frequency assembly without the impedance elements between diaphragm and main port outlet. The heavy line is the frequency response of the output of the main port in the near field, and the light curve is the comparable near field output of the loudspeaker cone. Below approximately 800 Hz, the main port acts as a lumped element device, providing the desired output for the system between approximately 130 Hz and 400 Hz. Above approximately 800 Hz, there are undesired resonance modes which, between approximately 1300 Hz and 2600 Hz, are greater than or comparable with the output of the cone. The resultant averaged frequency response of the system as a whole when used in a room is shown in FIG. 7, where the two largest peaks caused by waveguide modes of the main port occur in the frequency band from approximately 1000 Hz to approximately 3000 Hz.

Figure 9:
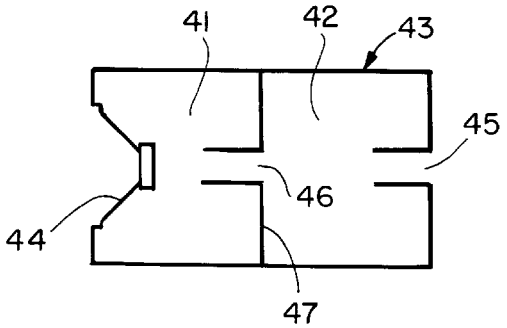
FIG. 9 is a diagrammatic representation of the enclosure with main port and internal dividing baffle with an intermediate port representative of the additional mass-compliance between the driver and port outlet.

Referring to FIG. 9, there is shown a diagrammatic representation of an acoustic impedance between the cone and main port in the form of an intermediate port. In enclosure 43, the main volume comprises subchambers 41 and 42 between output port 45 and driver 44 divided into the subchambers by sealed baffle 47. The front subchamber 41 is between driver 44 and baffle 47. The rear subchamber 42 is between baffle 47 and output port 45. The two subchambers 41 and 42 are connected by intermediate port 46 in the otherwise sealed baffle tuned to have its own lumped element resonance at a frequency typically at least an octave above the lumped element resonance and typically at least an octave below the transmission line resonance frequencies of the main port. At frequencies less than this intermediate port tuned frequency, the intermediate port 46 is effectively open, and the main port operates normally as an acoustic mass. At frequencies greater than the intermediate port tuned frequency, intermediate port 46 is effectively closed, sealing the main output port 45 from the driver so that the effective volume behind the driver is that of subchamber 41. This sealing effect prevents the driver from exciting the transmission line resonances of the main output port 45. The intermediate port tuned frequency is preferably greater than an octave above the system resonance ensuring that, at frequencies where the intermediate port 46 is effectively closed, the mechanical impedance presented to the driver motor is controlled by the moving mass of the driver rather than the effective volume and that the system efficiency is not affected when the effective volume behind the driver changes from that of the sum of the volumes of subchambers 41 and 42 to that of only the volume of front subchamber 41.

At high signal levels near the intermediate port tuned frequency, the transmission line modes of the main output port 45 could still be excited by noise caused by air turbulence in the intermediate port 46 having spectral components in the half-wavelength frequencies of the main output port 45. Constructing intermediate port 46 and baffle 47 from semi-rigid semi-breathable (porous) materials prevents such excitement.

Figure 10:
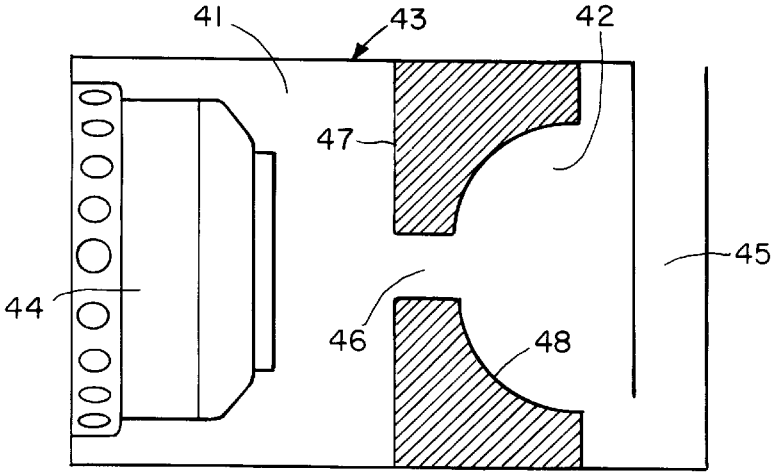
FIG. 10 is a pictorial sectional view of the upper frequency assembly enclosure according to the invention showing the semi-rigid foam sub-port feature.

Referring to FIG. 10, there is shown a pictorial sectional view of the upper frequency assembly enclosure showing the semi-rigid foam intermediate port arrangement 48. This structure forms internal baffle 47 which is partially penetratable but provides resistance to air flow. As a result, some portion of air flow between front subchamber 41 and back subchamber 42 may bypass intermediate port 46, reducing the flow velocity inside intermediate port 46. Porous baffle 47 also acts as an acoustic filter which dissipates energy. Because the material is also flexible and lossy, some energy is dissipated through mechanical damping as the device vibrates in response to acoustic pressure. Flow resistance, acoustic resistance and other properties of the material control a fraction of the volume velocity flowing through the opening. Too open a material makes intermediate port 46 ineffective while too closed a material makes intermediate port 46 turbulent. A preferred form of this material is 2 lb/cu.ft. density polyester polyurethane foam of 70 pores/linear inch available from Foamex under the trademark Pyrell. Other porous materials provide acceptable performance. This structure is an easy-to-insert, pre-cut, fitted piece of foam material that also furnishes desired acoustic damping and isothermal properties.

The illustrated part 48 functions as intermediate port 46 and baffle 47 providing acoustic damping with isothermal material made from a reticulated foam. This foam combines acoustic resistance and isothermal properties typically furnished by acoustic wadding, material with porosity, flexibility and mechanical loss properties of intermediate port 46 and baffle 47. Furthermore, the shape and dimensions are such that when placed properly in the enclosure, the flat front face is flush with the port wall and forms internal baffle 47. The slightly oversized dimensions and moderate flexibility of the foam provides a desired acoustic seal around the continuing periphery of baffle 47. The rectangular cutout along the middle of the foam part together with the flat surface of the enclosure against which it is placed form intermediate port 46. The remaining surfaces of the part are contoured to fill most of rear subchamber 42, leaving desired volumes in front of main output port 45 and behind the driver to allow for air flow at low frequencies. By choosing properties to facilitate isothermal cycles, the bulk of the material typically increases effective acoustic volume.

Figure 8:
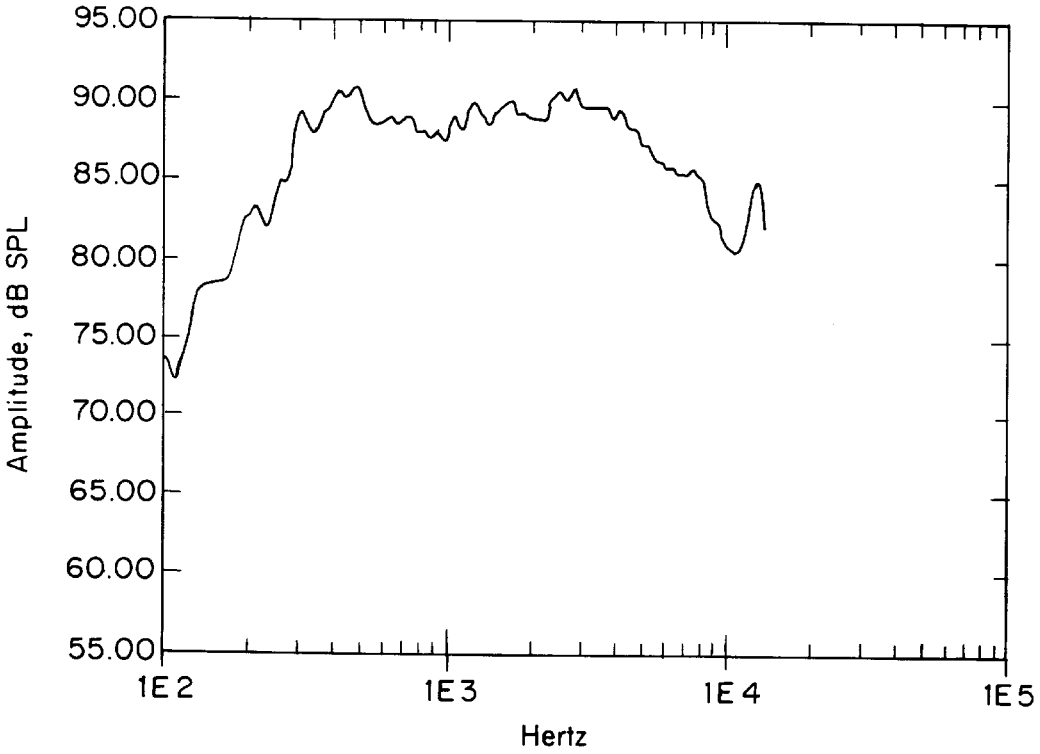
FIG. 8 shows the improved averaged frequency response in a room of the upper frequency assembly according to the invention with the added mass-compliance between driver and main port outlet.

Referring to FIG. 8, there is shown the averaged frequency response in a room of the upper frequency driver with the addition of the structure of FIG. 10, showing the absence of the undesired resonances between 1000 Hz and 3000 Hz.

Another feature of the invention that facilitates obtaining the desired sound radiating properties with small enclosure size is the feed-through connector for effecting connection from outside the enclosure to one or both drivers. The external cable for interconnecting each upper frequency assembly to the bass enclosure preferably has an impedance that is low compared to that of the driver in the enclosures. In an exemplary embodiment, cables of length 20 feet with molded-on keyed plugs at each end are used for this interconnection with 18 gauge wire used terminating in a female plug of 0.6725 inches diameter with connectors to contact 0.045×0.045 inch$^2$ pins on a pitch of 0.156 inches.

Figure 11A:
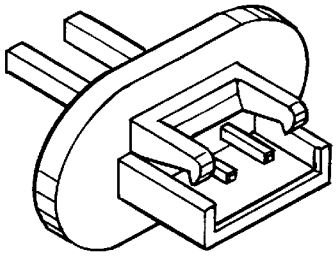
FIGS. 11A, 11B and 11C are perspective, plan and sectional views, respectively, of the feed-through plug for connecting between the driver and external cabling.
Figure 11B:
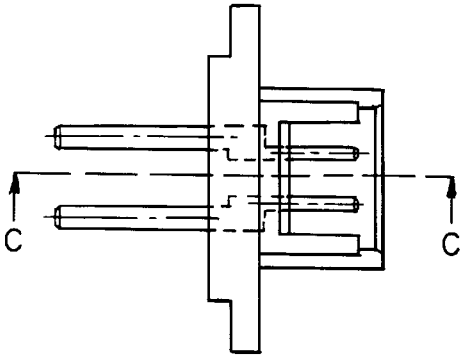
Figure 11C:
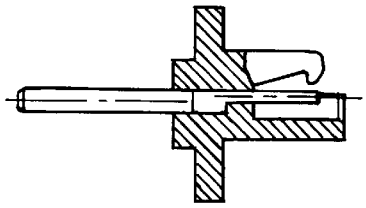

The connections between the drivers and the feed-through connector in the enclosure may be made with much smaller more flexible cable because the length is only a few inches, and impedance of this short cable relative to that of the driver is insignificant. These wires can conveniently be terminated in a small standard connector, such as the disconnectable crimp style. This connector connects to pins of 0.025×0.025 inch square connector on a 0.098 inch pitch. The feed-through connector in the enclosure provides an air tight connection between the outside and inside plugs having pins of different cross-sectional areas separated by different pitches. This feature of the invention forms each feed-through as a single item that varies in cross-sectional area and is bent so that when molded in a carrier with a second pin, the desired pitch is obtained at each end of the plug as shown in cross section in the perspective view of FIG. 11A, the plan view of FIG. 11B and the sectional view of FIG. 11C through section C—C of FIG. 11B.

Figure 12:
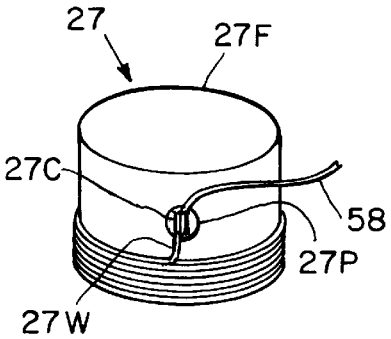
FIG. 12 is a perspective view of an advantageous way of establishing connection between a lead out and voice coil end using a crimp soldered to an anchor pad.
Figure 13:
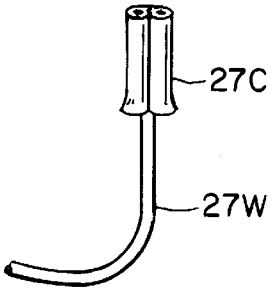
FIG. 13 is a fragmentary view of the voice coil wire end with attached crimp.

Referring to FIG. 12, there is shown a perspective view of an advantageous arrangement for connecting a lead out wire to the end of the voice coil. Voice coil 27 includes a former 27F and a winding 27W of single strand voice coil wire that terminates in crimp 27C. Former 27F carries conducting anchor pad 27P to which both crimp 27C and the end of lead out wire bundle 58 is soldered. FIG. 13 shows an enlarged view of crimp 27C attached to the end of winding 27W. Crimp 27C is typically tin plated on copper plated on brass pre-form and voice coil winding wire 27W is typically single strand #30 AWG or smaller. As is well known in the art, crimp 27C is a cold formed connection, connecting to the wire without soldering or welding; that is, a solderless contact. FIG. 13 shows typical dimensions in inches.

Figure 14A:
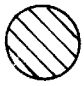
FIGS. 14A, 14B and 14C are end views of various conductors.
Figure 14B:
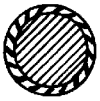
Figure 14C:
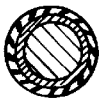

Referring to FIGS. 14A, 14B and 14C, there are shown end views of anodized aluminum wire, insulated copper wire and insulated copper clad aluminum wire, respectively.

This feature of the invention has a number of advantages. The invention makes possible the quick and repeatable electrical and mechanical termination of a voice coil wire or wires and is particularly useful where space for such termination is severely limited such as in the subject driver of this invention. By using a very small crimp which forms the connection of the power source to the voice coil, a single strand of fine gauge magnet wire or aluminum wire can be captured in a gas-tight manner. The crimp establishes good electrical connection without stripping insulation off the wire and without pre-tinning the wire end. The crimp allows repeatable electrical termination of aluminum wire, which is difficult to solder without corrosive side effects. The crimp itself can be securely anchored to a pad or substrate by soldering.

This feature of the invention reduces wire breakage, establishes connection without corrosive chemicals and affords a good gas-tight connection while allowing attachment of the lead out wire in a manner that enhances fatigue life of the lead out wire.

The enclosure according to the invention preferably has a volume less than 250 cc and a driver with an outer cone diameter of preferably less than approximately 5.0 cm to deliver audible spectral components in the range above the upper frequency at output levels as high as 105 dB sound pressure level at one meter without audible distortion. The driver has a suspension system that allows relatively large peak-to-peak motion for such a small cone (typically 3.5 mm peak-to-peak excursion) that is essentially a linear function of the signal amplitude applied to the voice coil for this excursion. The upper frequency assembly is characterized by a port-mass resonance that keeps the cone excursion within this range. The motor strength is unusually large for such a small driver. Features include structure suppressing undesired parasitic resonances, and little additional structure for confining magnetic fields to avoid interference, such as with picture tubes. The enclosure includes a novel pass-through connector for establishing connection between thin leads to the drivers and thicker leads to the amplifier.

Other embodiments are within the claims.

What is claimed is:

1. A loudspeaker system comprising, an upper frequency assembly for radiating acoustical energy with substantial audible spectral components in the audible frequency range only above a predetermined upper frequency of at least substantially 150 Hz, said upper frequency assembly including a ported enclosure having a front face of predetermined height and width, said enclosure enclosing a loudspeaker driver adjacent to said front face having a cone of diameter slightly less than at least one of said predetermined height and width, said driver having a moving voice coil of diameter greater than half said cone diameter in an airgap, said ported enclosure including a main port characterized by acoustic mass and an internal volume characterized by acoustic compliance to establish a fundamental mass-compliance resonant frequency near said predetermined upper frequency that keeps the maximum excursion of said diaphragm of at least 3.5 millimeters peak-to-peak to provide a predetermined maximum sound level for spectral components in the range above the predetermined upper frequency of output levels of at least 105 db substantially one meter therefrom on a driver axis without audible distortion.

2. A loudspeaker system in accordance with claim 1 wherein said loudspeaker driver has an efficiency β of at least 1.6 Newtons$^2$ per watt.

3. A loudspeaker system in accordance with claim 1 wherein said loudspeaker driver has pot type magnetic structure with a pot, said pot being formed with an annular extension at the outermost portion of the pot with an airspace between the end of the extension and a portion of the pot defining the airgap for said voice coil to reduce magnetic fringing flux.

4. A loudspeaker system in accordance with claim 1 wherein said voice coil comprises a former having a conducting pad, a voice coil winding having an end terminated in an attached crimp, said crimp being soldered to said anchor pad.

5. A loudspeaker system in accordance with claim 4 and further comprising a lead out wire having an end soldered to said conducting anchor pad.

6. A loudspeaker system in accordance with claim 1 wherein said loudspeaker driver comprises, a magnetic structure, a rigid subassembly separate from said magnetic structure, and a moving assembly movable along the axis of said driver and having first and second flexible members mounted on said rigid subassembly at locations axially spaced along the driver axis.

7. A loudspeaker system in accordance with claim 6, wherein said rigid subassembly is a basket, said magnetic structure comprises a pot, central pole piece and permanent magnet, and said moving assembly comprises a cone, voice coil, surround and spider with said surround being said first flexible member and said spider being said second flexible member.

8. A loudspeaker system in accordance with claim 1, wherein said predetermined upper frequency is of the order of 200 Hz, the volume of said enclosure being less than 250 cc.

9. A loudspeaker system comprising, an upper frequency assembly for radiating acoustical energy with spectral components in the audible frequency range above a predetermined upper frequency, said upper frequency assembly including a ported enclosure having a front face of predetermined height and width, said enclosure enclosing a loudspeaker driver adjacent to said front face having a cone of diameter slightly less than at least one of said predetermined height and width, said driver having a voice coil of diameter greater than half said cone diameter, said ported enclosure including a main port characterized by acoustic mass and an internal volume characterized by acoustic compliance to establish a fundamental mass-compliance resonant frequency near said predetermined upper frequency that keeps the maximum excursion of said diaphragm within predetermined limits to provide a predetermined maximum sound level for spectral components within said audible frequency range above said predetermined frequency without audible distortion, wherein said enclosure further includes an internal baffle and an intermediate port in said baffle, said internal baffle dividing said enclosure into an inside subchamber adjacent to said driver and an outside subchamber adjacent to said main port, said intermediate port characterized by an intermediate acoustic mass and said output subchamber characterized by output subchamber compliance to establish an intermediate port-acoustic-mass-output-subchamber-acoustic-compliance resonant frequency that is at least one octave above said fundamental mass-compliance resonant frequency.

10. A loudspeaker system in accordance with claim 9 wherein said intermediate port is formed in semi-rigid foam seated in said enclosure.

11. A loudspeaker system in accordance with claim 10 wherein said semi-rigid foam is constructed and arranged to suppress standing waves and form said internal baffle.

12. A loudspeaker system comprising, an upper frequency assembly for radiating acoustical energy with spectral components in the audible frequency range above a predetermined upper frequency, said upper frequency assembly including a ported enclosure having a front face of predetermined height and width, said enclosure enclosing a loudspeaker driver adjacent to said front face having a cone of diameter slightly less than at least one of said predetermined height and width, said driver having a voice coil of diameter greater than half said cone diameter, said ported enclosure including a main port characterized by acoustic mass and an internal volume characterized by acoustic compliance to establish a fundamental mass-compliance resonant frequency near said predetermined upper frequency that keeps the maximum excursion of said diaphragm within predetermined limits to provide a predetermined maximum sound level for spectral components within said audible frequency range above said predetermined frequency without audible distortion, and a feed-through connector in a wall of said enclosure having an inside terminal pair connected to an outside terminal pair with the cross-sectional area of each outside terminal different from the cross-sectional area of each inside terminal and the separation between the inside terminals is different from the separation between the outside terminals wherein each of the terminals of the terminal pair consists of a continuous conductor.

13. A loudspeaker system comprising, an upper frequency assembly for radiating acoustical energy with substantial audible spectral components in the audible frequency range only above a predetermined upper frequency of about 200 Hz, said upper frequency assembly including a ported enclosure of volume less than about 250 cc having a front face of predetermined height and width, said enclosure enclosing a loudspeaker driver adjacent to said front face having a driver axis with a cone of diameter slightly less than at least one of said predetermined height and width and less than approximately 5.0 cm, said loudspeaker driver comprising a motor with a voice coil attached to said cone, said ported enclosure including a main port characterized by acoustic mass and an internal volume characterized by acoustic compliance to establish a fundamental mass-compliance resonant frequency near said predetermined upper frequency that keeps the maximum excursion of said cone of at least 3.5 millimeters peak-to-peak to provide a predetermined maximum sound level of at least 105 dB substantially one meter therefrom on said driver axis over substantially all said audible frequency range above said predetermined upper frequency without audible distortion.

14. A loudspeaker system in accordance with claim 13 wherein said voice coil comprises a former having a conducting pad, a voice coil winding having an end terminated in an attached crimp, said crimp being soldered to said anchor pad.

15. A loudspeaker system in accordance with claim 14 and further comprising a lead out wire having an end soldered to said conducting anchor pad.

16. A loudspeaker system in accordance with claim 13, wherein said enclosure encloses said loudspeaker driver adjacent to said front face having a cone of diameter slightly less than said predetermined height and said predetermined width, the volume of said enclosure being less than 250 cc.

17. A loudspeaker system comprising, an upper frequency assembly for radiating acoustical energy with spectral components in the audible frequency range above a predetermined upper frequency of about 200 Hz, said upper frequency assembly including a ported enclosure of volume less than about 250 cc having a front face of predetermined height and width, said enclosure enclosing a loudspeaker driver adjacent to said front face having a driver axis with a cone of diameter slightly less than at least one of said predetermined height and width and less than approximately 5.0 cm, said driver comprising a motor with a voice coil attached to said cone, said ported enclosure including a main port characterized by acoustic mass and an internal volume characterized by acoustic compliance to establish a fundamental mass-compliance resonant frequency near said predetermined upper frequency that keeps the maximum excursion of said cone of at least 3.5 millimeters peak-to-peak to provide a predetermined maximum sound level of at least 105 dB substantially one meter therefrom on said driver axis over substantially all said audible freguency range above said predetermined upper frequency without audible distortion, and a bass enclosure separate from said upper frequency assembly constructed and arranged for connection to said upper frequency assembly for radiating acoustical energy with spectral components in the bass frequency range below said predetermined upper frequency.

18. A loudspeaker system driver having a moving voice coil in an airgap and a pot type magnetic structure with a pot, said pot formed with an outer portion and with an annular extension extended from the outer portion of the pot with an airspace between the end of the extension and the end of the outer portion of the pot to reduce magnetic fringing flux, wherein the end of the outer portion is formed with an inner pole for defining the airgap for said moving voice coil.

19. A loudspeaker enclosure characterized by acoustic compliance having a main port characterized by acoustic mass and an internal baffle with an intermediate port in said internal baffle, said internal baffle dividing said enclosure into an outside subchamber adjacent to said main port and an inside subchamber, said intermediate port characterized by an intermediate acoustic mass and said outside subchamber characterized by output subchamber compliance to establish an intermediate port acoustic-mass-output-subchamber-acoustic compliance resonant frequency that is at least one octave above the fundamental acoustic mass-acoustic compliance resonant frequency established by the acoustic mass of said main port and the compliance of said enclosure.

20. A loudspeaker system comprising, an upper frequency assembly for radiating acoustic energy with substantial audible spectral components in the audible frequency range only above a predetermined upper frequency of the order of 200 Hz, said upper frequency assembly having a loudspeaker driver having a driver axis with a cone of diameter less than substantially 5 centimeters, said driver having an efficiency $\beta$ of at least 1.6 Newtons$^2$/watt, said upper frequency assembly constructed and arranged to provide a predetermined maximum sound level of at least 105 dB substantially one meter therefrom on said driver axis over substantially all said audible frequency range above said predetermined upper frequency without audible distortion.

21. A loudspeaker system comprising, at least first and second upper frequency assemblies for radiating acoustical energy with spectral components in the audible frequency range above a predetermined upper frequency, each upper frequency assembly including an enclosure having an enclosure volume of less than 250 cc and constructed and arranged to provide a predetermined maximum sound pressure level of at least 90 dB substantially one meter therefrom over substantially all said audible frequency range above said predetermined upper frequency without audible distortion, and a nonlocalizable bass enclosure separate from said upper frequency assemblies constructed and arranged for connection to said upper frequency assemblies for radiating acoustical energy with spectral components in the bass frequency range below said predetermined upper frequency, whereby localization only occurs on said upper frequency assemblies.

22. A loudspeaker system in accordance with claim 21 wherein the distance between each of said first and second upper frequency assemblies and said nonlocalizable bass enclosure is less than substantially 10 meters.

23. A loudspeaker system in accordance with claim 21 wherein said predetermined upper frequency is substantially 200 Hz, and each upper frequency assembly is constructed and arranged to provide a predetermined maximum sound pressure level of at least 99 dB substantially one meter therefrom over substantially all said audible frequency range above said predetermined upper frequency without audible distortion.

24. A loudspeaker system comprising, first and second upper frequency assemblies, each upper frequency assembly for radiating acoustical energy with spectral components in the audible frequency range above a predetermined upper frequency of about 200 Hz, said upper frequency assembly including a ported enclosure of volume less than about 250 cc having a front face of predetermined height and width, said enclosure enclosing a loudspeaker driver adjacent to said front face having a driver axis with a cone of diameter slightly less than at least one of said predetermined height and width and less than approximately 5.0 cm, said driver comprising a motor with a voice coil attached to said cone, said ported enclosure including a main port characterized by acoustic mass and an internal volume characterized by acoustic compliance to establish a fundamental mass-compliance resonant frequency near said predetermined upper frequency that keeps the maximum excursion of said cone within predetermined limits to provide a predetermined maximum sound level of at least 105 dB substantially one meter therefrom on said driver axis over substantially all said audible frequency range above said predetermined upper frequency without audible distortion, and a nonlocalizable bass enclosure separate from said upper frequency assemblies constructed and arranged for connection to said upper frequency assemblies for radiating acoustical energy with spectral components in the bass frequency range below said predetermined upper frequency, whereby localization only occurs on said upper frequency assemblies.

25. A loudspeaker system comprising, an upper frequency assembly for radiating acoustical energy with spectral components in the audible frequency range above a predetermined upper frequency of about 200 Hz, said upper frequency assembly including a ported enclosure having a front face of predetermined height and width and less than approximately 5.0 cm, said enclosure enclosing a loudspeaker driver adjacent to said front face having a cone of diameter slightly less than at least one of said predetermined height and width and less than approximately 5.0 cm, said driver comprising a motor with a voice coil, said ported enclosure including a main port characterized by acoustic mass and an internal volume characterized by acoustic compliance to establish a fundamental mass-compliance resonant frequency near said predetermined upper frequency and coacts with said motor to establish a maximum excursion of said cone of at least 3.5.

26. A loudspeaker system comprising, an upper frequency assembly for radiating acoustic energy with substantial audible spectral components in the audible frequency range only above a predetermined upper frequency of the order of 200 Hz, said upper frequency assembly having a loudspeaker driver having a cone of diameter less than substantially 5 centimeters, said driver having an efficiency $\beta$ of at least 1.6 Newtons$^2$/watt, said upper frequency assembly constructed and arranged to establish a maximum linear axial motion of said cone of at least 3.5 millimeters peak-to-peak over substantially all said audible frequency range above said predetermined upper frequency without audible distortion.

* * * * *